US007357596B2

(12) United States Patent
Face, III et al.

(10) Patent No.: US 7,357,596 B2
(45) Date of Patent: Apr. 15, 2008

(54) CONCRETE SCREED WITH MOVABLE LEADING EDGE

(75) Inventors: S. Allen Face, III, Wilmington, NC (US); Albert D. Frankeny, II, Round Hill, VA (US)

(73) Assignee: Laser Strike LLC, Wilmington, NC (US)

( * ) Notice: Subject to any disclaimer, the term of this patent is extended or adjusted under 35 U.S.C. 154(b) by 282 days.

(21) Appl. No.: 11/126,632

(22) Filed: May 11, 2005

(65) Prior Publication Data

US 2006/0257206 A1 Nov. 16, 2006

(51) Int. Cl.

| | |
|---|---|
| ***E01C 23/07*** | (2006.01) |
| ***E01C 19/22*** | (2006.01) |
| ***E01C 19/42*** | (2006.01) |
| *E01C 23/00* | (2006.01) |
| *E01C 19/00* | (2006.01) |

(52) U.S. Cl. ..... 404/118; 404/83; 404/84.1

(58) Field of Classification Search ..... 404/118, 404/83–85

See application file for complete search history.

(56) References Cited

U.S. PATENT DOCUMENTS

| | | | | |
|---|---|---|---|---|
| 3,415,173 | A * | 12/1968 | Paul | 404/118 |
| 3,838,933 | A * | 10/1974 | Lehman et al. | 404/114 |
| 3,850,541 | A * | 11/1974 | Baillet et al. | 404/114 |
| 4,861,188 | A * | 8/1989 | Rouillard | 404/75 |
| 5,039,249 | A * | 8/1991 | Hansen et al. | 404/84.5 |
| 5,549,413 | A * | 8/1996 | Bolden | 404/93 |
| 6,089,787 | A * | 7/2000 | Allen et al. | 404/118 |
| 6,679,652 | B2 * | 1/2004 | Suriano | 404/97 |
| 6,779,945 | B2 * | 8/2004 | Saffo, Sr. | 404/118 |
| 6,923,595 | B1 * | 8/2005 | Chek | 404/118 |
| 6,953,304 | B2 * | 10/2005 | Quenzi et al. | 404/114 |
| 6,976,805 | B2 * | 12/2005 | Quenzi et al. | 404/114 |
| 7,121,762 | B2 * | 10/2006 | Quenzi et al. | 404/84.1 |
| 7,195,423 | B2 * | 3/2007 | Halonen et al. | 404/84.5 |
| 2006/0120801 | A1 * | 6/2006 | Johnson | 404/118 |

* cited by examiner

*Primary Examiner*—Raymond W Addie
(74) *Attorney, Agent, or Firm*—Peter J. Van Bergen

(57) ABSTRACT

A floating screed device has an elongated float and an elongated blade movably coupled to the elongated float so that the blade is movable in pitch.

12 Claims, 3 Drawing Sheets

CONCRETE SCREED WITH MOVABLE LEADING EDGE

FIELD OF THE INVENTION

The invention relates generally to screeding devices, and more particularly to a floating screed device that has a movable leading edge.

BACKGROUND OF THE INVENTION

Floating screeds are used to strike off and finish concrete floors or other horizontal surfaces. In general, a floating screed has a heavy planar float with an elongated edge defining a blade. The blade forms the leading edge of the screed that cuts through a volume of plastic concrete as the screed is pulled therethrough. Excess concrete that builds up on the blade side of the screed is raked away by workers standing in the unfinished concrete. As the float moves over an area of the concrete cut by the blade, the float serves to smooth the concrete thereby leaving a finished region of concrete that should be smooth, level, and at a specified elevation.

To achieve the desired elevation, the screed operator is constantly pushing down or pulling up on the screed to adjust the position of the screed's blade edge. However, since the screed's blade edge and float are linked, the pitch of the float tracks the pitch of the blade edge which can affect the pitch and target elevation of the finished region of concrete. Furthermore, since the blade edge and float are linked, the screed operator's efforts required to change pitch can be substantial.

SUMMARY OF THE INVENTION

Accordingly, it is an object of the present invention to provide a floating screed device that can be controlled to produce smooth and level concrete surfaces at a desired elevation.

Other objects and advantages of the present invention will become more obvious hereinafter in the specification and drawings.

In accordance with the present invention, a floating screed device has an elongated float for floating on plastic concrete and an elongated blade movably coupled to the elongated float. The elongated blade is movable in pitch as the elongated float floats on the plastic concrete.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
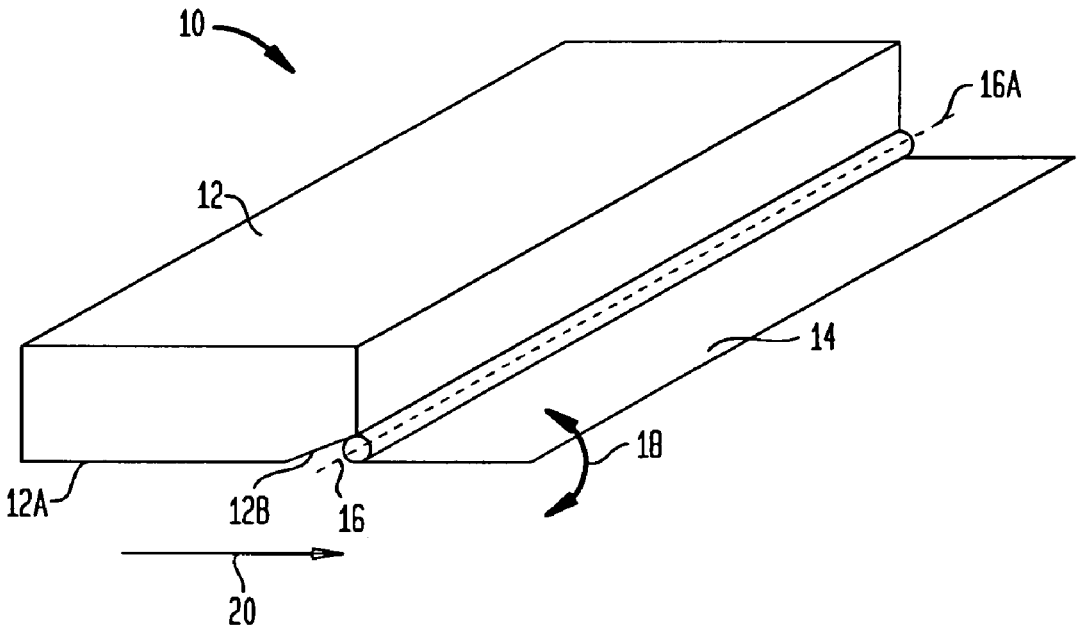
FIG. 1 is a perspective view of a floating screed device according to an embodiment of the present invention.

Referring now to the drawings, and more particularly to FIG. 1, an embodiment of a floating screed device in accordance with the present invention is shown and is referred generally by numeral 10. Floating screed device 10 is an elongate device as would be well understood in the art. Floating screed device 10 includes an elongate float 12, an elongate blade 14 and a hinge 16 that allows blade 14 to pivot about the longitudinal axis 16A of hinge 16 as indicated by a two-headed arrow 18. Thus, when a planar bottom 12A of float 12 is floating on a plastic concrete surface (not shown) to be finished, blade 14 is movable in pitch as floating screed device 10 is pulled over the concrete surface in the direction of arrow 20. In this configuration, blade 14 defines the leading edge of floating screed device 10.

It is to be understood that the design and/or shape of float 12, blade 14 and hinge 16 are not limitations of the present invention. For example, float 12 can be substantially rectangular in cross-section (as shown) having a beveled, lower leading edge 12B to facilitate movement over concrete. However, float 12 could be defined by other geometric shapes without departing from the scope of the present invention. Float 12 could be hollow, solid, or filled with a granular material, a solid material or a fluid. With respect to blade 14, its shape and construction details can be any shape that would allow blade 14 to cut through plastic concrete as floating screed device 10 was moved along direction 20. With respect to hinge 16 its design and construction can be any that would permit and limit movement of blade 14 in pitch 18. Hinge 16 could be a continuous element or discrete elements positioned along the lengths of float 12 and blade 14. Further, hinge 16 could be a hardware element or a flexible coupling that permitted movement in pitch 18.

Figure 2:
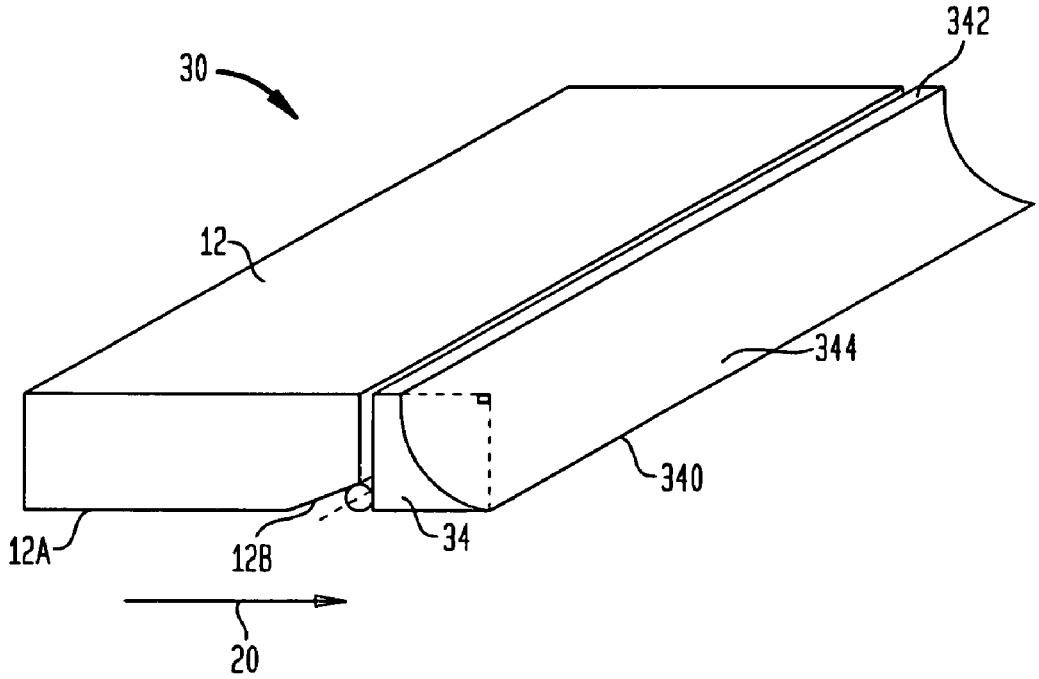
FIG. 2 is a perspective view of a floating screed device according to another embodiment of the present invention.

Referring now to FIG. 2, another embodiment of a floating screed device in accordance with the present invention is shown and is referred generally by numeral 30. Floating screed device 30 again includes float 12 and hinge 16, both of which function as described above. However, device 30 differs from device 10 in that blade 34 (movably coupled to float 12 by hinge 16) facilitates the screeding operation by its unique design. More specifically, blade 34 has the following unique design features:

(i) an elongate leading edge 340 that forms the initial contact or cutting edge of floating screed device 30 as it moves on/through plastic concrete in direction 20, (ii) a top 342 that is planar, and (iii) an arcuate face 344 defined between leading edge 340 and top 342.

For reasons that will be explained further below, arcuate face 344 should define a smooth and gently curved surface with the portion thereof near top 342 being substantially vertical when blade 34 is resting on a concrete surface. For example, the shape of arcuate face 344 can be defined by a circular arc of 90° as shown, although angles between approximately 85-90° can be used. Again, for reasons that will be explained further below, arc angles greater than 90° should be avoided.

Figure 3A:
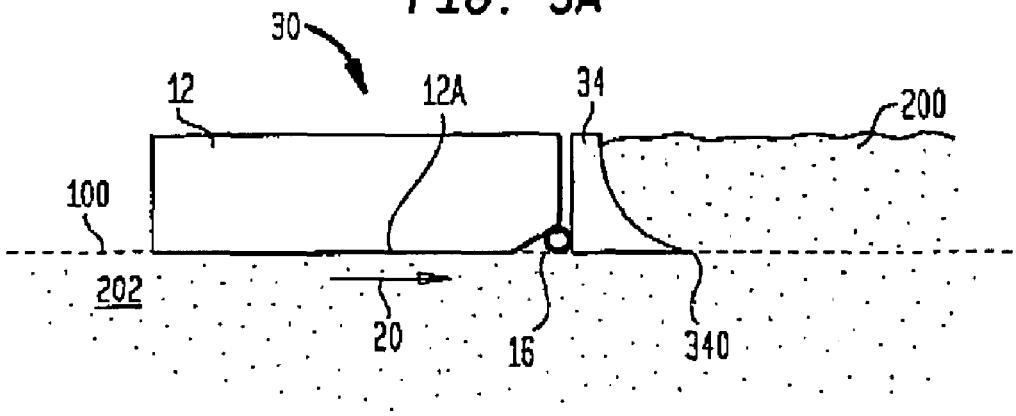
FIG. 3A is a side schematic view of the floating screed device of FIG. 2 operating at a target elevation.

The present invention improves the screeding operation as the floating screed device is more easily manipulated to a finished-concrete target elevation. To illustrate operation of the present invention, reference will now be made to FIGS. 3A-3C where a target elevation for a finished concrete surface is illustrated by dashed line 100. In general, target elevation 100 is the height of a horizontal datum that defines what should be the finished concrete surface. For purpose of illustration, operations will be described using floating screed device 30 moving in direction 20. Relative to direction 20, an unfinished volume of plastic concrete 200 is forward of device 30 while finished concrete 202 trails device 30. Volume 200 is typically at a height above target elevation 100 so that blade 34 must cut therethrough.

In use, whatever the orientation of bottom 12A of float 12 (i.e., horizontal, tilted, at target elevation 100, or above/below target elevation 100), leading edge 340 of blade 34 is kept at target elevation 100. For example, floating screed device 30 is "on grade" (i.e., bottom 12A of float 12 is at target elevation 100) in FIG. 3A and leading edge 340 of blade 34 is kept at target elevation 100 as shown.

Figure 3B:
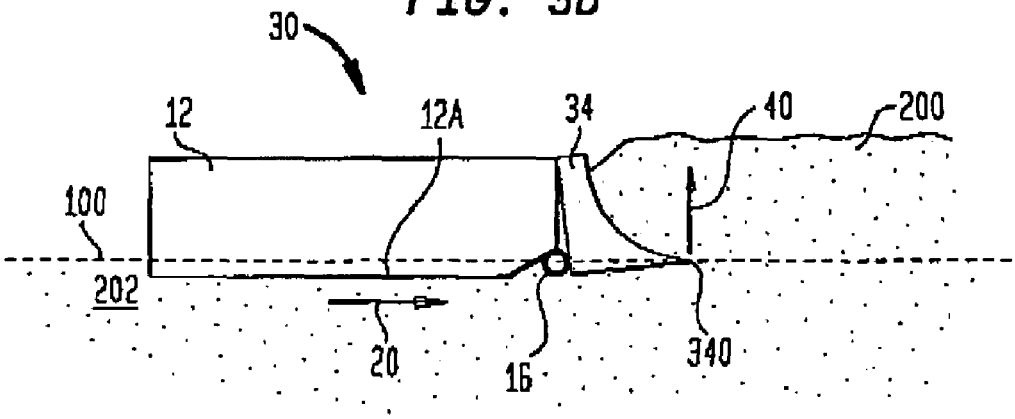
FIG. 3B is a side schematic view of the floating screed device of FIG. 2 operating below a target elevation.

In FIG. 3B, bottom 12A of float 12 is below target elevation 100. The following sequence of operations are used to put device 30 back on grade. First, blade 34 is pitched or tilted up as illustrated (by application of a force represented by arrow 40) to position leading edge 340 at target elevation 100. As device 30 advances in direction 20, float 12 pitches up as it encounters an uphill slope in the concrete created by the upwardly-tilted blade 34. Then, as float 12 (now inclining upward) climbs uphill, blade 34 is rotated/tilted downward (relative to float 12) in order to keep leading edge 340 at target elevation 100. In response, float 12 pitches down to follow the concrete profile created by blade 34. Blade 34 is then rotated/tilted upward again (relative to float 12) to keep leading edge 340 at target elevation 100. The above-described continuous rotation/tilting of blade 34 (to keep leading edge 340 at target elevation 100) as float 12 changes elevation and inclination will, during the course of travel of device 30, horizontally align bottom 12A and blade 34 at target elevation 100.

Figure 3C:
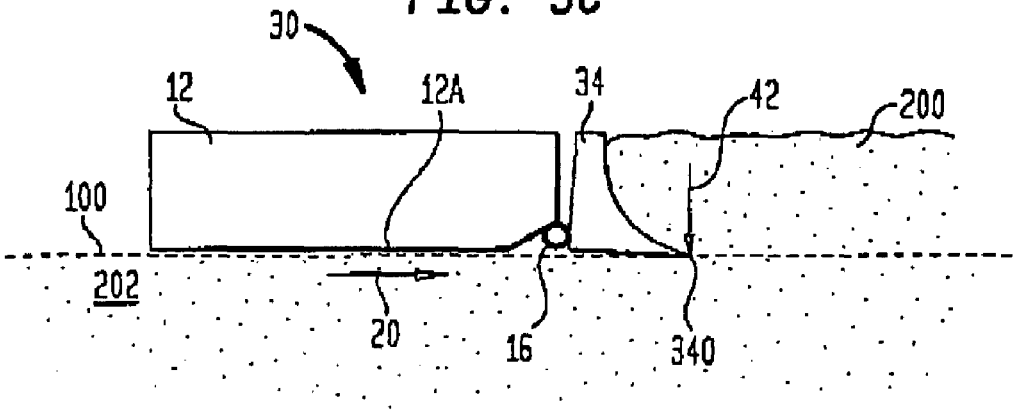
FIG. 3C is a side schematic view of the floating screed device of FIG. 2 operating above a target elevation.

For the situation defined by bottom 12A of float 12 being above target elevation 100 as illustrated in FIG. 3C, the following sequence of operations are used to put device 30 back on grade. First, blade 34 is pitched or tilted down as illustrated (by application of a force represented by arrow 42) to position leading edge 340 at target elevation 100. As device 30 advances in direction 20, float 12 pitches down as it encounters a downhill slope in the concrete created by the downwardly-tilted blade 34. Then, as float 12 (now inclining downward) descends downhill, blade 34 is rotated/tilted upward (relative to float 12) in order to keep leading edge 340 at target elevation 100. In response, float 12 pitches up to follow the concrete profile created by blade 34. Blade 34 is then rotated/tilted downward again (relative to float 12) to keep leading edge 340 at target elevation 100. Once again, the above-described continuous rotation/tilting of blade 34 (to keep leading edge 340 at target elevation 100) as float 12 changes elevation and inclination will, during the course of travel of device 30, horizontally align bottom 12A and blade 34 at target elevation 100.

Figure 4:
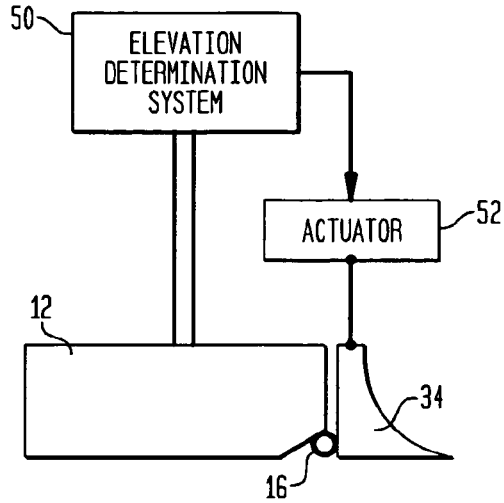
FIG. 4 is a side schematic view of the floating screed device of FIG. 2 further equipped with a system for adjusting the pitch of the screed device's movable blade.

The application of forces 40 (FIG. 3B) and 42 (FIG. 3C) can be automated. An example of such automation is illustrated in FIG. 4 where an elevation determination system 50 is mounted to float 12. For example, system 50 can be part of a laser level system, the use of which in concrete floor construction is well known and understood. In general, elevation determination system 50 determines the height of float 12 relative to a target height (i.e., target elevation 100). The output of system 50 is an amount of pitch that blade 34 must be moved to achieve the target height as floating screed device 30 is moved. An actuator 52 is coupled to system 50 and blade 34, and is used to apply the requisite amount of up or down force to blade 34 to bring about the necessary amount of blade pitch as blade 34 pivots about hinge 16.

Blade 34 (illustrated in the FIG. 2 embodiment) provides an added advantage in the present invention as arcuate face 344 defines a rake guide for concrete workers standing in the volume of plastic concrete forward of the screed device. Each of these workers watches the area just forward of blade 34 and scrapes concrete away from blade 34 when there is too much and pushes concrete towards blade 34 when there is too little. Both the scraping and pushing operations are carried out using a concrete rake (not shown), the design of which is not a limitation of the present invention. In terms of the scraping operation, arcuate face 344 facilitates raking as a rake's blade edge can follow the smooth surface of arcuate face 344. By not allowing the arc of arcuate face 344 to exceed 90°, a worker's rake can drop in easily anywhere on arcuate face 344. In addition, the planer surface of top 342 provides a landing area for a rake should a worker overshoot the top of arcuate face 344.

Figure 5A:
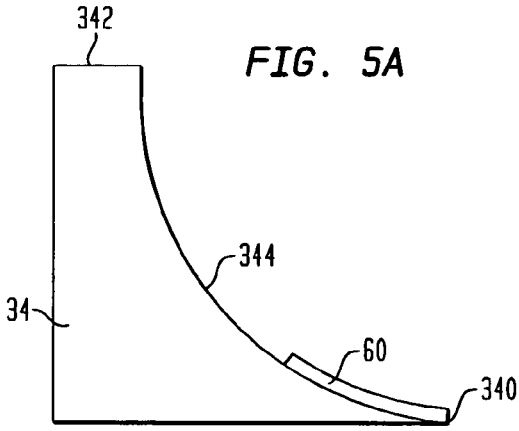
FIG. 5A is an isolated side view of the floating screed device's movable blade of FIG. 2 further having visual indicia on a lower portion of the blade's arcuate face.
Figure 5B:
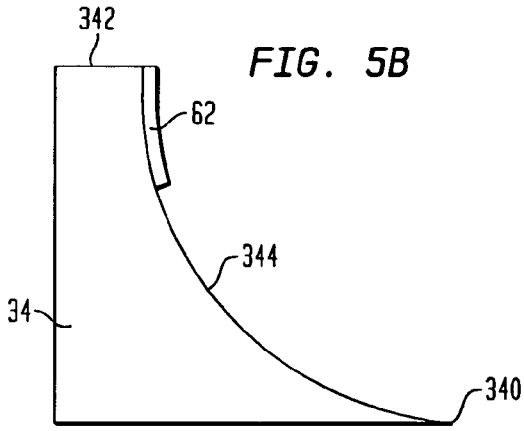
FIG. 5B is an isolated side view of the floating screed device's movable blade of FIG. 2 further having visual indicia on an upper portion of the blade's arcuate face.
Figure 5C:
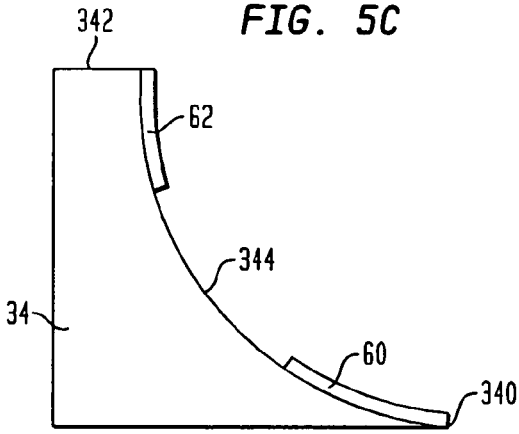
FIG. 5C is an isolated side view of the floating screed device's movable blade of FIG. 2 further having visual indicia on the upper and lower portions of the blade's arcuate face.
Figure 5D:
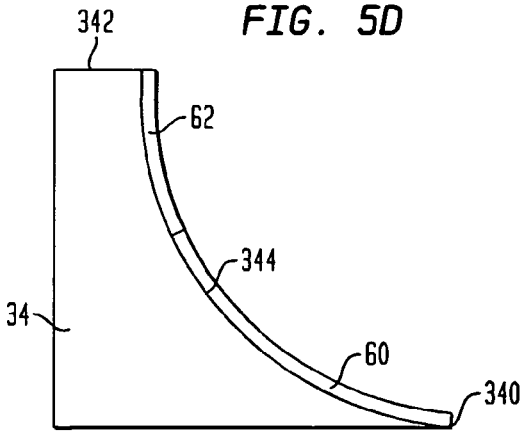
FIG. 5D is an isolated side view of the floating screed device's movable blade of FIG. 2 further having visual indicia on all of the blade's arcuate face.

The advantages of blade 34 can be further enhanced by applying (e.g., attaching, coating, painting, etc.) one or more visual indicia on arcuate face 344 in order to aid the concrete workers' raking operations. For example, one or more bright colors (e.g., fluorescent, neon, or any other color that is different than the concrete being finished) could be applied to arcuate face 344 to serve as indications of when concrete needed to be scraped from or pushed toward blade 34. Several possible and non-limiting examples are illustrated in FIGS. 5A-5D. In FIG. 5A, visual indicia 60 appears on arcuate face 344 in a visually continuous or discontinuous fashion in the lower region of arcuate face 344 along leading edge 340. FIG. 5B depicts visual indicia 62 on arcuate face 344 in a visually continuous or discontinuous fashion in the upper region of arcuate face 344 near top 342. In FIG. 5C, both visual indicia 60 and 62 are on arcuate face 344. In this embodiment, two different colors could be used with visual indicia 60 being one color and visual indicia 62 being a different color. The appearance of visual indicia 62 might indicate that it may soon be time to push concrete toward blade 34 whereas the appearance of visual indicia 60 would indicate that concrete needed to be immediately pushed toward blade 34. FIG. 5D is an extension of FIG. 5C in that visual indicia 60 and 62 cover the entirety of arcuate face 344. Still another option would be to provide a different visual indicia (not shown) on top 342.

Thus, although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A floating screed device comprising:

a first section defining a leading edge for cutting through plastic concrete;

a second section for floating on the plastic concrete;

coupling means for movably coupling said first section to said second section to thereby allow said leading edge to be independently moved in pitch relative to a horizontal datum defined in the plastic concrete wherein a pitch orientation of said first section relative to said horizontal datum is independent of a pitch orientation of said second section relative to said horizontal datum; and adjusting means coupled to said first section for adjusting the pitch of said leading edge relative to said horizontal datum as said floating screed device is moved through a volume of the plastic concrete that is unfinished with said leading edge defining an initial contact edge between said floating screed device and the volume of the plastic concrete that is unfinished.

2. A floating screed device as in claim 1 wherein said adjusting means moves said leading edge towards a target elevation of the plastic concrete.

3. A floating screed device as in claim 1 wherein said leading edge is blade-shaped.

4. A floating screed device as in claim 1 wherein said first section has an arcuate face extending up from said leading edge to a top edge thereof.

5. A floating screed device as in claim 4 wherein said arcuate face defines an arc not to exceed 90°.

6. A floating screed device as in claim 4 further comprising visual indicia applied on at least a portion of said arcuate face.

7. A floating screed device as in claim 6 wherein said visual indicia comprises a color different from that of the plastic concrete.

8. A floating screed device comprising:

an elongated float for floating on plastic concrete; and an elongated blade movably coupled to said elongated float wherein said elongated blade is independently movable in pitch relative to said elongated float as said elongated float floats on the plastic concrete; and adjusting means coupled to said elongated blade for adjusting the pitch thereof relative to a target elevation in the plastic concrete as said floating screed device is moved through a volume of the plastic concrete that is unfinished with said elongate blade defining an initial contact edge between said floating screed device and the volume of the plastic concrete that is unfinished.

9. A floating screed device as in claim 8 wherein said elongated blade has an arcuate face.

10. A floating screed device as in claim 9 wherein said arcuate face defines an arc not to exceed 90°.

11. A floating screed device as in claim 9 further comprising visual indicia on at least a portion of said arcuate face.

12. A floating screed device as in claim 11 wherein said visual indicia comprises a color different from that of the plastic concrete.

* * * * *